US005390633A

United States Patent [19]

Taue

[11] Patent Number: 5,390,633

[45] Date of Patent: Feb. 21, 1995

[54] REED VALVE MECHANISM FOR RECIPROCATING MACHINE

[75] Inventor: June Taue, Iwata, Japan

[73] Assignee: Yamaha Hatsudoki Kabushiki Kaisha, Iwata, Japan

[21] Appl. No.: 86,511

[22] Filed: Jul. 1, 1993

[30] Foreign Application Priority Data

Jul. 6, 1992 [JP] Japan ..... 4-177979

[51] Int. Cl.[6] ..... F02B 33/04

[52] U.S. Cl. ..... 123/65 V; 123/73 V; 137/856

[58] Field of Search ..... 123/65 V, 73 V; 137/856; 251/65, 285

[56] References Cited

U.S. PATENT DOCUMENTS

| | | | |
|---|---|---|---|
| 4,089,348 | 5/1978 | Yoshida et al. | 137/856 |
| 4,739,732 | 4/1988 | Nakamura | 123/65 V |
| 4,748,944 | 6/1988 | Iida et al. | 123/73 V |
| 4,836,151 | 6/1989 | Litjens et al. | 123/65 V |
| 4,970,996 | 11/1990 | Matsuo et al. | 123/73 V |
| 5,033,419 | 7/1991 | Plohberger et al. | 123/73 V |
| 5,245,956 | 6/1993 | Martin | 123/73 V |

FOREIGN PATENT DOCUMENTS

| | | | |
|---|---|---|---|
| 0160512 | 9/1983 | Japan | 123/65 V |
| 62-67231 | 3/1987 | Japan . | |
| 4-148022 | 5/1992 | Japan . | |

*Primary Examiner*—Andrew M. Dolinar
*Assistant Examiner*—M. Macy
*Attorney, Agent, or Firm*—Knobbe, Martens, Olson & Bear

[57] ABSTRACT

A number of embodiments of improved reed valve mechanisms for reciprocating machines wherein an arrangement is provided by employing a magnet releasably restraining the valve element in one of its positions so as to permit a stiffer valve to be employed while, at the same time, insuring against loss of volumetric efficiency and control. An adjustable stopper plate is also described.

19 Claims, 3 Drawing Sheets

REED VALVE MECHANISM FOR RECIPROCATING MACHINE

BACKGROUND OF THE INVENTION

This invention relates to a reed valve mechanism for a reciprocating machine and more particularly to an improved reed valve mechanism for such an application that will insure efficient operation of the valve under all machine operations.

In many applications of reciprocating machines, there are employed reed valves permitting flow in one direction while precluding flow in an opposite direction. For example, such reed type valves are employed in the induction system for crankcase compression, two cycle, internal combustion engines so as to permit an air flow into the crankcase chambers of the engine and preclude reverse flow when the inducted charge is compressed in the crankcase chamber. Such types of reed valve mechanisms have the advantages of simplicity and relatively low costs.

However, it is necessary to insure that the reed valve may open easily and fully to permit substantially unrestricted flow in one direction. However, it is also desirable to insure that the valve will promptly and fully close once the pressure difference reverses so as to insure against any loss of charge when compression occurs. These objectives are relatively inconsistent with each other.

Furthermore, the opening and closing of the valves in reciprocating machines occur at a relatively high frequency, particularly when the machine is operated at high rates of speed. This will give further problems in connection with insuring that the valves open fully and yet close fully without bouncing or other effects caused by the high speed at which the machine is operating.

Due to the variations in speed and load, a reed type valve that is designed to provide good performance under one condition will not necessarily provide adequate performance under other conditions. Conventional types of reed type valves are fairly design specific and do not accommodate widely varying conditions.

It is, therefore, a principal object to this invention to provide an improved reed type valve arrangement for a reciprocating machine.

It is a further object to this invention to provide a reed valve for a reciprocating machine that will insure of ease of opening and full opening so as to improve volumetric efficiency while at the same time insuring good and complete closure of the valve.

It is a further object to this invention to provide an improved reed valve mechanism for a reciprocating machine wherein the operational characteristics of the valve may be changed during machine operation.

It is a yet further object to this invention to provide an improved reed type valve mechanism for a reciprocating machine wherein the maximum opening position of the reed type valve can be controlled during machine operation to suit machine running characteristics.

SUMMARY OF THE INVENTION

A first feature of this invention is adapted to be embodied in a reed valve mechanism for a reciprocating machine that is comprised of a variable volume chamber and a flow passage communicating with the chamber. A reed type valve element is positioned within the flow passage for permitting flow therethrough in one direction when in an open position and prohibiting flow in the other direction when in a closed position. Magnet means are provided for releasably restraining the reed valve element in at least one of its positions.

A second feature of this invention is also adapted to be embodied in a reed valve mechanism for a reciprocating machine of the type described in the proceeding paragraph. In conjunction with such a second feature of the invention, a stopper is provided for controlling the maximum opening position of the reed type valve and means are provided for varying the position of the stopper in response to engine running characteristics.

DETAILED DESCRIPTION OF THE PREFERRED EMBODIMENTS OF THE INVENTION

Figure 1:
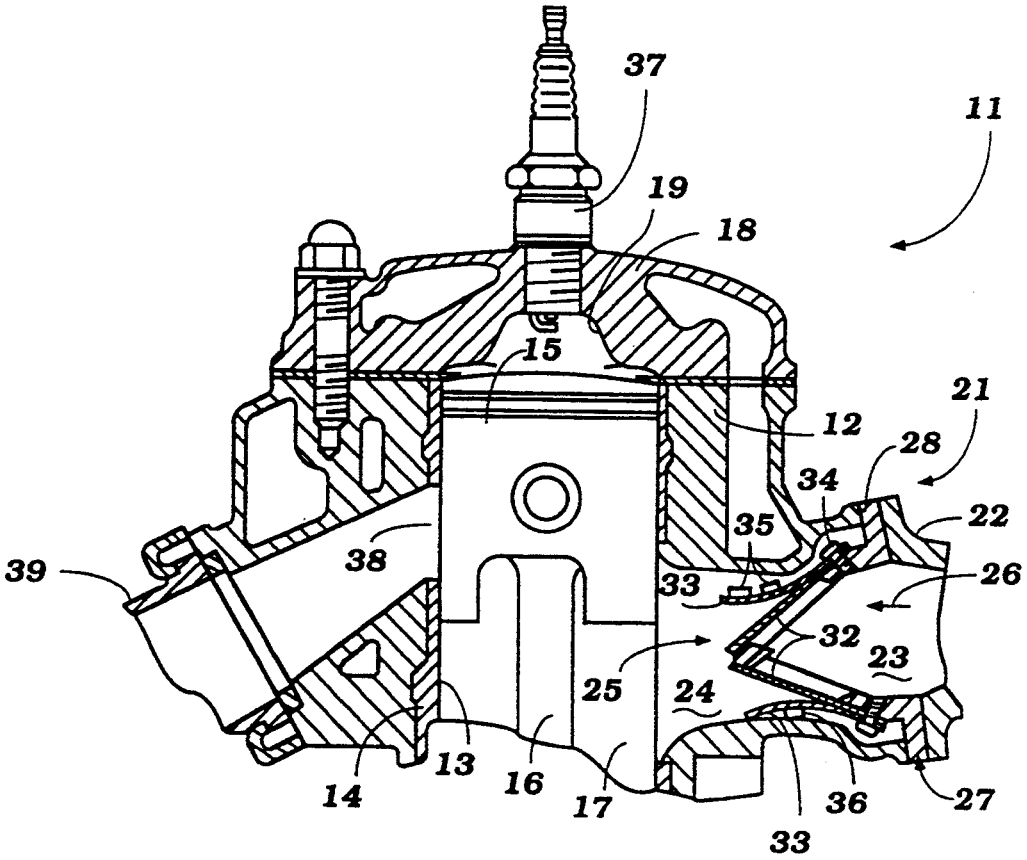
FIG. 1 is a partial cross sectional view taken through a signal cylinder of an engine constructed in accordance with an embodiment of the invention.
Figure 2:
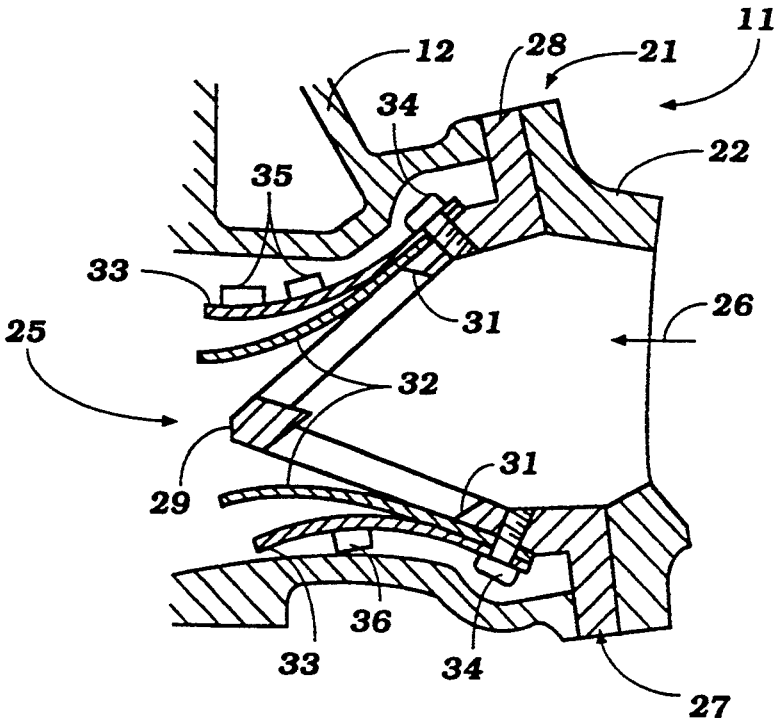
FIG. 2 is an enlarged view of the induction system and the reed type valve of this embodiment.

Referring now in detail to the drawings and initially to the embodiment of FIGS. 1 and 2, an internal combustion engine constructed in accordance with this embodiment of the invention is identified generally by the reference numeral 11. In the illustrated embodiment, the engine 11 is of a two cycle, crankcase compression type and includes one or more cylinders. Since it should be readily apparent to those skilled in the art how the invention can be practiced with multiple cylinders, the illustration of only a single cylinder is all that is believed to be necessary to enable those skilled in the art to understand how the invention may be employed. Also, although the invention is described in conjunction with a two cycle, crankcase compression engine it should be readily apparent that the invention may be used with other types of machines and particularly reciprocating machines including compressors or the like.

The engine 11 is comprised of a cylinder block 12 which is shown partially and which forms one or more cylinder bores 13, as by the use of pressed or cast-in cylinder liners 14. Pistons 15 reciprocate in the cylinder bores 13 and are connected by means of connecting rods 16 to a crankshaft (not shown) that is rotatable within a crankcase chamber 17 formed by the cylinder block 12 and a crankcase member (not shown)that is affixed to the cylinder block 12 in any suitable and well known manner.

A cylinder head 18 is affixed to the cylinder block 12 on the side thereof opposite the crankcase member and defines a recess 19 which, with the piston 15 and cylinder bore 13 form a combustion chamber of the engine 11.

An induction system, indicated generally by the reference numeral 21 is provided for delivering a fuel/air charge to the crankcase chamber 17 of the engine. Although the system is described in conjunction with a fuel/air charge, it is to be understood that the invention may be practiced with arrangements wherein only an air charge is delivered to the crankcase chamber 17 and fuel is sprayed directly into the combustion chamber 19 or at any other part of the engine by any type of fuel injection system.

The induction system 21 includes an intake manifold 22 that has an induction passage 23 which receives an air charge from the atmosphere and a fuel charge, if desired. This charge is delivered to an intake port 24 formed in the cylinder block 12. A reed type check valve assembly, indicated generally by the reference numeral 25 and constructed in accordance with an embodiment of the invention, is positioned in the intake port 24 between the intake manifold 22 and the cylinder block 12 for permitting flow to the crankcase chamber 17 in the direction shown by the arrows 26 while precluding flow in the reverse direction.

The reed type check valve assembly 25 is shown in most detail in enlarged FIG. 2 and includes a caging member 27 that has a flange 28 that is affixed between the cylinder block 12 and manifold 22 in a known manner. This caging member has a generally V-shape configuration with a bridging portion 29 being disposed adjacent to the crankcase chambers 17. Flow openings 31 are formed in the angularly inclined portions of the caging member 27.

A pair of reed type valves 32 are positioned in confronting relationship to the openings 31 and are held in place by a mechanism to be described. A pair of stopper plates 33 are disposed outwardly of the reed type valve elements 32 and are held along with these valve elements 32 to the caging member 27 by means of threaded fasteners 34. The stoppers 33 limit the maximum degree of opening of the reed type valves 32 with FIG. 2 showing the valves in a partially opened position.

As is well known, when the piston 15 moves upwardly to cause an expansion in the effective volume of the crankcase chamber 17, the pressure in the induction passage 23 will be greater than the pressure in the crankcase chamber 17 and the reed valves 32 will open and permit the charge to be drawn into the crankcase chamber 17. As the pistons 15 move downwardly, this charge will then be compressed and the reed type valve elements 32 will be forced to their closed position.

In order to insure full opening of the valves 32 and good volumetric efficiency, it has been the practice to make the valves 32 rather thin and relatively resilient. However, when this is done then the reed type valve elements 32 may not close as rapidly or as fully as desired and, furthermore, this lightweight construction and high flexibility may give rise to fluttering in the valves and loss of volumetric efficiency. However, if stiffer valves are employed, then the valves have a difficult time fully opening and the volumetric efficiency will also decrease.

In accordance with the invention, an arrangement is provided for assisting in full opening of the reed type valves 32 and restraining them slightly in their open position so as to permit the use of a stiffer valve element than previously employed. This is accomplished by the provision, in this embodiment, of a pair of permanent magnets 35 that are affixed to one of the stopper plates 33 and a single permanent magnet 36 which is affixed to the remaining stopper plate. Thus, when the valves 32 move toward their open position and considering that they are made from a ferro-magnetic material, the magnets 35 and 36 will attract the valve elements and assist in their full opening. In addition, the magnets 35 and 36 will tend to restrain the valve elements 32 from closing until a predetermined pressure is exerted at which time the relatively stiff material of the valves 32 can cause them to move completely and fully to their closed position and maintain sealing without bouncing open again. This is all achieved without added moving parts.

The charge which has been admitted to the crankcase chamber 17 and which is compressed in the manner aforedescribed, will then be transferred through one or more scavenge ports (not shown) to the combustion chamber 19. This charge is then further compressed during upward movement of the piston 15 and is fired by a spark plug 37 in a known manner so as to drive the piston 15 downwardly.

An exhaust port 38 is provided in the wall of the cylinder 12 and communicates with an exhaust system, shown partially at 39, for the discharge of the exhaust gases to the atmosphere.

Figure 3:
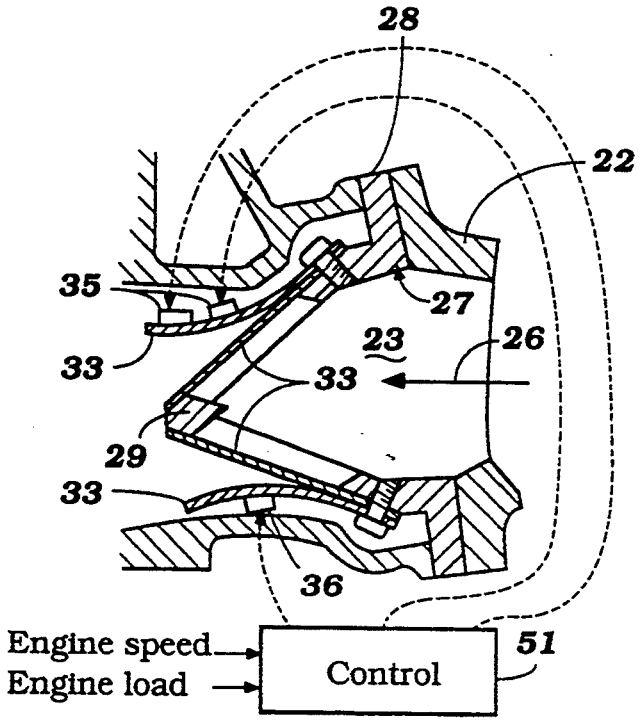
FIG. 3 is an enlarged cross sectional view, in part similar to FIG. 2, and shows another embodiment of the invention.

In the embodiment of the invention as thus far described, the magnets 35 and 36 have been permanent magnets and thus provide a fixed effect. FIG. 3 shows another embodiment of the invention which is generally the same, but in this embodiment the magnets 35 and 36 are not permanent magnets but are electromagnets energized by a control, shown schematically at 51. This control 51 receives signals indicative of engine running conditions such as an engine speed and engine load signal as indicated by the arrows and is developed with a control strategy so as to vary the amount of electrical force generated by the electromagnets 35 and 36 and also so as to switch them on and off so as to control the effect in response to running engine variables.

Figure 4:
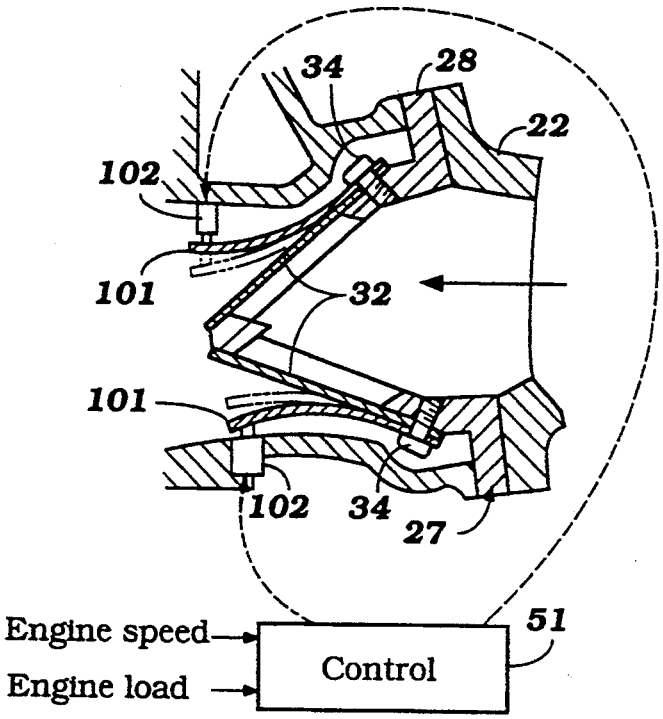
FIG. 4 is an enlarged cross sectional view, in part similar to FIGS. 2 and 3, and shows yet another embodiment of the invention.

FIG. 4 shows another embodiment of the invention having an engine speed and load control 51 as in the embodiment of FIG. 3 and wherein the general construction of the reed type valve assembly is the same as that previously described. Where the elements are the same or substantially the same, they have been identified by the same reference numerals and will be described again only insofar as is necessary to understand the construction and operation of this embodiment.

In this embodiment, the stopper plates 101 are also somewhat flexible and their actual position is varied between the solid line position shown in FIG. 4 and the phantom line position by means of a pair of electrically controlled plungers 102 that are operated by the control 51. As a result of this construction, the maximum degree of opening of the valve elements 32 can be controlled and this will also provide additional control over the functioning of the valve elements 32 and permit quicker and more positive operation when desired. In addition, the plungers 102 may be magnetic so as to provide the magnetic attraction like the embodiment of FIG. 3.

Alternatively, the stopper plates 101 may be formed from a hard rubber and the reed valve elements 32 may be formed from a material such as a resinous material so as to permit better operation. Of course, if this is done, then the magnetic effect of the other embodiments cannot be enjoyed.

Figure 5:
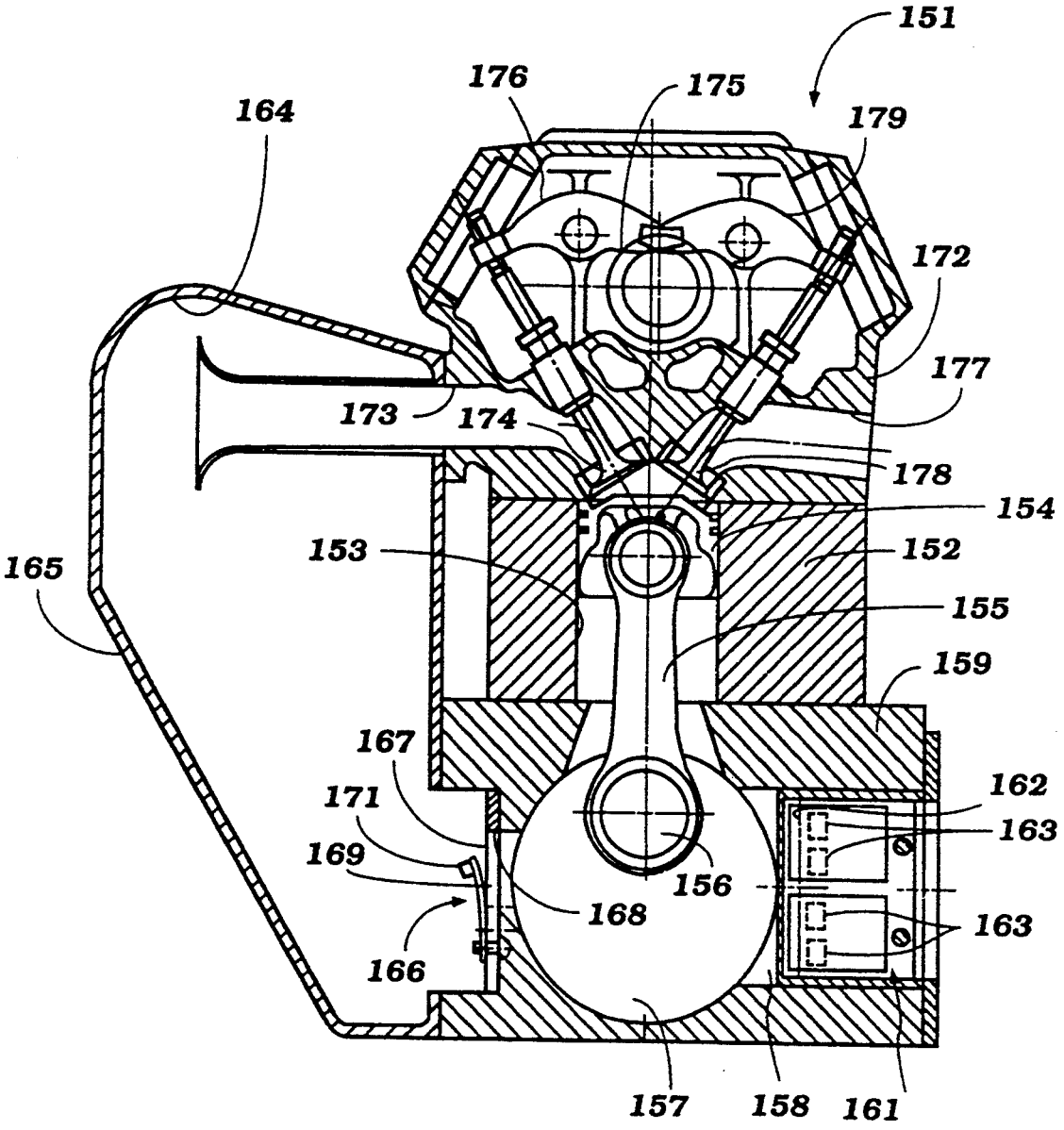
FIG. 5 is a cross sectional view taken through a signal cylinder of an engine constructed in accordance with another embodiment of the invention.

FIG. 5 shows the application of the invention to an internal combustion engine, indicated generally by the reference numeral 151, wherein the engine operates on a crankcase compression principal but does not employ scavenge passages and also employs poppet type intake and exhaust valves. Again, the invention is described in conjunction with a single cylinder but it should be readily apparent to those skilled in the art how the invention may be employed with multiple cylinder engines.

The engine 151 includes a cylinder block 152 having one or more cylinder bores 153 in which pistons 154 reciprocate. The pistons 154 are connected to connecting rods 155 which, in turn, are journalled on the throws 156 of a crankshaft 157. The crankshaft 157 is journalled for rotation in a crankcase chamber 158 formed by the cylinder block 152 and a crankcase member 159 that is affixed in any suitable manner to the cylinder block 152.

A reed type valve assembly, indicated generally by the reference numeral 161 and having a construction as of the embodiment of FIGS. 1 and 2, 3 or 4 is employed for permitting a charge to be drawn into the crankcase chambers 158 and, at the same time, precluding reversal and flow. These reed type valves assemblies 161 include reed type valve elements 162 that control the flow through flow passages as previously described. Permanent magnets 163 or other flow controlling arrangements as shown in either FIGS. 2, 3 or 4 may be employed so as to control the opening of the reed type valves 162 and also permit the use of stiffer valves than with the previous type of constructions.

The charge which is compressed in the crankcase chambers 158 is transferred to a plenum chamber 164 formed by a cover plate 165 that is fixed to one side of the engine with the communication being controlled by further reed type valve assemblies 166 which may also be constructed as any of the previously described embodiments. These reed type valve assemblies 166 include valve elements 167 which control the opening of flow passages 168. A stopper plate 169 controls the maximum degree of opening and permanent magnets 171, electric magnets or electrically controlled devices, may be employed for modulating the operation of the reed type valve elements 167 as previously described.

In conjunction with this embodiment, a cylinder head 172 is affixed in a suitable manner to the cylinder block 152 and is formed with one or more intake passages 173 that communicate with the plenum chamber 164. Poppet type valves 174 control valve seats at the base of the intake passages 173 and are operated by means of an overhead mounted cam 175 that is driven from the crankshaft 157 in a known manner and which operates the valves 174 through rocker arms 176. Return springs (not shown) are employed. Hence, the valves 174 may be opened at the appropriate timing and the engine operates to some extent like a four cycle engine but has better flow control because of the use of the poppet valves.

Exhaust passages 177 are formed in the side of the cylinder head 172 opposite from the intake passages 173 and are controlled by exhaust valves 178 that are also operated by the camshaft 175 through rocker arms 175.

It should be readily apparent from the foregoing description that the described embodiments of the invention provide very effective reed type valve assemblies for reciprocating machines. Although the application to various types of two cycle, crankcase compression engines have been described, it should be readily apparent to those skilled in the art how the invention may be employed with air compressors or other types of machines. Also, the foregoing description is that of preferred embodiments of the invention and various changes and modifications may be made without departing from the spirit and scope of the invention, as defined by the appended claims.

I claim:

1. A reed valve mechanism for a reciprocating machine comprised of a variable volume chamber, a flow passage communicating with said chamber, a reed valve element positioned within said flow passage for permitting flow therethrough in one direction when in an open position and prohibiting flow in the other direction when in a closed position, a stopper plate fixed relative to said reed valve element in said flow passage for limiting the opening movement of said reed valve element, and a magnet juxtaposed to an open position of said reed valve element for retaining said reed valve element in said open position and positioned so that said reed valve element does not directly engage said magnet.

2. A reed valve mechanism as set forth in claim 1 wherein the magnet is fixed relative to the flow passage.

3. A reed valve mechanism as set forth in claim 1 wherein the magnet comprises an electromagnet.

4. A reed valve mechanism as set forth in claim 3 wherein the electromagnet is controlled in response to running conditions of the machine.

5. A reed valve mechanism as set forth in claim 4 wherein the running condition comprise speed.

6. A reed valve mechanism as set forth in claim 4 wherein the running condition comprising load.

7. A reed valve mechanism as set forth in claim 6 wherein the running condition also comprises speed.

8. A reed valve mechanism as set forth in claim 3 wherein the electromagnet is fixed to the machine.

9. A reed valve mechanism as set forth in claim 8 wherein the electromagnet is fixed relative to the flow passage.

10. A reed valve mechanism as set forth in claim 9 wherein the electromagnet is controlled in response to running conditions of the machine.

11. A reed valve mechanism as set forth in claim 10 wherein the running condition comprise speed.

12. A reed valve mechanism as set forth in claim 10 wherein the running condition comprising load.

13. A reed valve mechanism as set forth in claim 12 wherein the running condition also comprises speed.

14. A reed valve mechanism as set forth in claim 2, wherein the magnet is fixed to the stopper plate on the side thereof facing away from the reed valve element so that the reed valve element does not contact said magnet.

15. A reed valve mechanism as set forth in claim 10, wherein the magnet is fixed to the stopper plate on the side thereof facing away from the reed valve element so that the reed valve element does not contact said magnet.

16. A reed valve mechanism for a reciprocating machine comprised of a variable volume chamber, a flow passage communicating with said chamber, a reed valve element positioned within said flow passage for permitting flow therethrough in one direction when in an open position and prohibiting flow in the other direction when in a closed position, and a stopper plate for controlling the open position of said reed vale element, said stopper plate being moveable in response to an engine running condition for varying the maximum degree of opening of said reed valve element in response to said engine running condition.

17. A reed valve mechanism as set forth in claim 16 wherein the running condition comprise speed.

18. A reed valve mechanism as set forth in claim 16 wherein the running condition comprising load.

19. A reed valve mechanism as set forth in claim 18 wherein the running condition also comprises speed.

* * * * *